US006557507B2

(12) United States Patent
Rosenbush et al.

(10) Patent No.: US 6,557,507 B2
(45) Date of Patent: May 6, 2003

(54) ROCKER ARM ASSEMBLY

(75) Inventors: Richard E. Rosenbush, Metamora, IL (US); Matthew K. Johnson, Champlin, MN (US); Damon B. Vaughan, Lasalle (CA)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/822,108

(22) Filed: Mar. 30, 2001

(65) Prior Publication Data

US 2002/0139337 A1 Oct. 3, 2002

(51) Int. Cl.[7] ..... F01L 1/18

(52) U.S. Cl. ..... 123/90.39; 123/90.48; 123/90.61

(58) Field of Search ..... 123/90.39, 90.41, 123/90.45, 90.48, 90.61; 74/519, 559; 403/122, 135, 144; 29/888.2

(56) References Cited

U.S. PATENT DOCUMENTS

| | | | | | |
|---|---|---|---|---|---|
| 4,570,582 | A | | 2/1986 | Speil | |
| 4,602,604 | A | | 7/1986 | Kauer | |
| 4,708,103 | A | | 11/1987 | Speil | |
| 4,729,350 | A | | 3/1988 | Speil | |
| 4,793,307 | A | | 12/1988 | Quenneville et al. | |
| 4,815,424 | A | | 3/1989 | Buuck et al. | |
| 4,856,468 | A | | 8/1989 | Speil et al. | |
| 5,092,703 | A | * | 3/1992 | Kobayashi | 403/122 |
| 5,114,261 | A | * | 5/1992 | Sugimoto et al. | 403/122 |
| 5,395,176 | A | * | 3/1995 | Zivkovic | 403/122 |
| 5,456,136 | A | * | 10/1995 | Yamashita | 74/569 |
| 5,479,896 | A | | 1/1996 | Freiburg et al. | |
| 5,507,261 | A | | 4/1996 | Johnson, Jr. | |
| 5,542,315 | A | | 8/1996 | Carroll, III et al. | |
| 5,609,133 | A | | 3/1997 | Hakansson | |
| 5,671,707 | A | * | 9/1997 | Purcell | 123/90.37 |
| 5,680,838 | A | | 10/1997 | See et al. | |
| 6,138,624 | A | * | 10/2000 | Wolck et al. | 123/90.36 |
| 6,273,042 | B1 | * | 8/2001 | Perez | 123/90.39 |

FOREIGN PATENT DOCUMENTS

| | | |
|---|---|---|
| JP | 11-280417 A | 10/1999 |

* cited by examiner

*Primary Examiner*—Thomas Denion
*Assistant Examiner*—Jaime Corrigan
(74) *Attorney, Agent, or Firm*—Rogitz & Associates

(57) ABSTRACT

A rocker arm assembly has a rocker arm that forms an adjusting mechanism bore, an insert bore, and a transverse central bore. An adjusting mechanism, e.g., a screw, is installed in the adjusting mechanism bore and is used to adjust the travel of the rocker arm as it pivots about the central bore during normal operation. An insert having a hemispherical end is installed in the insert bore. Additionally, a button that forms a hemispherical chamber that is sized and shaped to be received to the hemispherical end of the insert is press fitted onto the insert. As the rocker arm assembly pivots about the central bore the button rotates with respect to the insert. The cooperation of structure between the insert and the button allows the button to rotate with respect to the insert, but prevents the button from falling off the insert and damaging the engine in which the rocker arm assembly is installed.

18 Claims, 1 Drawing Sheet

ROCKER ARM ASSEMBLY

TECHNICAL FIELD

The present invention relates generally to a valve trains of an engine and more particularly to an interfacing between components of the valve train.

BACKGROUND ART

A typical four stroke compression engine includes a plurality of cylinders, a piston movably disposed within each cylinder, and a cylinder head. The valve train has a series of intake and exhaust valves positioned in the cylinder head, e.g. many engines have two intake and two exhaust valves per cylinder. As the pistons travel between a bottom dead center position and a top dead center position the valves are opened and closed by other valve train components allowing the engine to operate efficiently and effectively. More specifically, the operation of the valve train components require related components to transfer motion through an arcuate configuration and result in frictional contacting relationships. Such motion and configurations require pivotal joints and require an assembly of such pivotal joints to be substantially secured to prevent detachment of assembled components.

Within the valve train are a plurality of rocker arms, usually one rocker arm per valve or per a pair of valves. The rocker arms pivot about a shaft and are driven by push rods to open and close the valves during normal operation of the engine. In many present day engines each rocker arm has an insert therein having a button connected on the insert by an O-ring seal. The button engages a surface of a valve bridge to activate a pair of valves. The corresponding rocker arm pivots and the button pivots with respect to the valve bridge. Past experience has shown that the above described type of assembly is prone to premature failure due to grit from the engine being carried by the engine lubricating oil getting wedged between the O-ring seal and the insert or button. The grit eventually loges between the insert and the button and prevents the button from pivoting, fatigues and eventually causes the button to separate from the insert. The loose component can travel within the interior of the engine and cause premature failure of the engine The present invention is directed to overcome one or more of the problems as set for the above.

DISCLOSURE OF THE INVENTION

In one aspect of the invention a rocker arm assembly has a rocker arm forming an insert bore. An insert is disposed within the insert bore and the insert including a hemispherical distal end. And, a button forms a hemispherical chamber which is sized and shaped to receive the hemispherical distal end of the insert. The button is press fitted onto the insert.

In another aspect of the invention a method for assembling a rocker arm assembly has the following steps. Providing an insert having a hemispherical end. Providing a button forming a hemispherical chamber that is sized and shaped to receive the hemispherical end. And, pressing the button onto the insert.

BEST MODE FOR CARRYING OUT THE INVENTION

Figure 1:
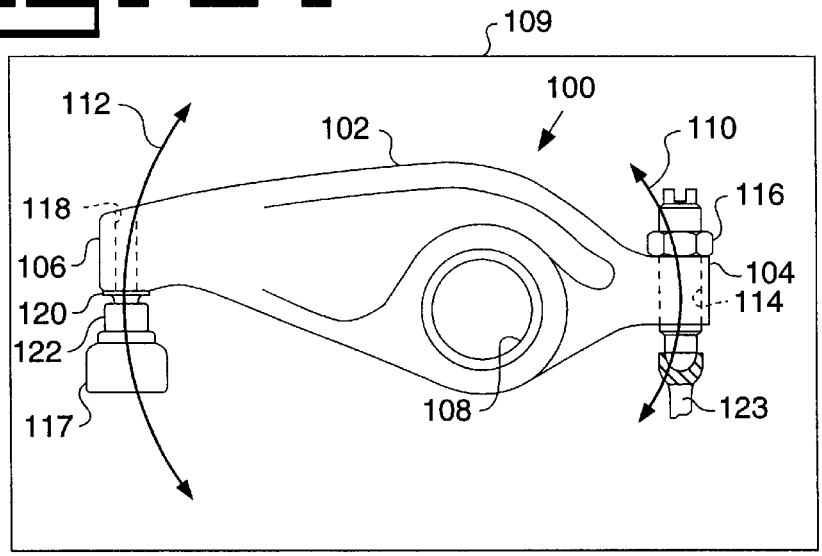
FIG. 1 is a side plan view of the rocker arm embodied in the present invention.

Referring to FIG. 1, a rocker arm assembly 100 is shown. In FIG. 1 the rocker arm assembly 100 includes a rocker arm 102 being made of steel having a proximal end 104 and a distal end 106. The rocker arm 102 is formed with a transverse central bore 108 about which the rocker arm 102 is pivotally attached when installed in a typical valve train assembly of an engine 109, shown schematically. The pivotal motion of the rocker arm 102 is indicated by an arc 110 and an arc 112.

The proximal end 104 of the rocker arm 102 is formed with an adjusting mechanism bore 114 being threaded (indicated by dashed lines in FIG. 1) that is perpendicular to the transverse central bore 108. Disposed within the adjusting mechanism bore 114 is an adjusting mechanism 116 which in this application is a screw. The adjusting mechanism 116 is in contact with an end of a push rod 123.

The distal end 106 of the rocker arm 102 is formed with a insert bore 118 (indicated by dashed lines in FIG. 1). The insert bore 118 is perpendicular to the transverse central bore 108 and parallel to the adjusting mechanism bore 114. Disposed within the insert bore 118 is a generally cylindrical insert 120 being preferably made of steel and being described below. In this application, the insert 120 is press fitted into the insert bore 118. As shown in FIG. 1, a button 122 is preferably made of steel and is described below. In this application the button 122 is press fitted onto the insert 120. The button 122 is in contact with an end or a contact surface of a valve bride 117. When a single valve per cylinder is used, the button is in contact with an end of a valve 117'.

Figure 2:
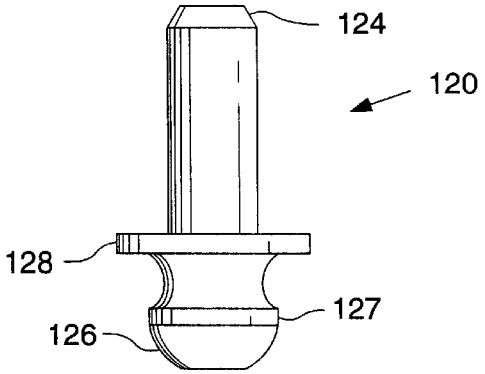
FIG. 2 is a side plan view of the insert embodied in the present invention.
Figure 3:
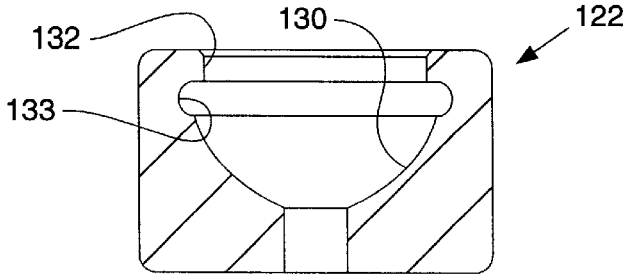
FIG. 3 is a cross-sectional view of the button embodied in the present invention.

Referring to FIGS. 2 and 3, the insert 120 has a tapered distal end 124 and a hemispherical proximal end 126. A flange 128 extends radially from the insert 120 near the proximal end 126 of the insert 120. The flange 128 is positioned a predetermined distance form the proximal end 126. Additionally, the hemispherical proximal end 126 of the insert 120 forms a shank 127 that engages a neck 132 of the button 122, described below. The shank 127 has a preestablished diameter and is spaced from the proximal end 126 a predetermined distance. When the insert 120 is installed in the rocker arm 102 as shown in FIG. 1, the distal end 124 of the insert 120 is within the bore 118 formed in the distal end 106 of the rocker arm 102, the flange 128 is tight against the rocker arm 102, and the proximal end 126 of the insert 120 extends from the rocker arm 102.

Referring further to FIG. 3, the button 122 is formed with a hemispherical chamber 130 that is sized and shaped to receive the hemispherical proximal end 126 of the insert 120. Additionally, the neck 132 is formed at an end of the button 122 and has a diameter being less than that of the hemispherical chamber 130 by a predetermined distance. As shown in FIG. 3, at the inner extremity of the neck 132 is an undercut 133. The shank 127 of the insert 120 is press fitted past the neck 132 and rests in the undercut. With the button 122 pressed onto the insert 120, the neck 132 engages the shank 127 holding the button 122 on the insert 120 while allowing relative motion between the button 122 and the insert 120. The size and shape of the respective hemispherical proximal end 126 of the insert 120 and the hemispherical chamber 130 of the button 122 enables the button 122 and the insert 120 to rotate or swivel.

It is to be understood that the press fit between the insert 120 and the button 122 has to be sufficiently tight to allow the neck 132 to engage the shank 127 and hold the button 122 on the insert 120 during operation, but with sufficient clearance to allow the insert 120 and button 122 to be assembled.

INDUSTRIAL APPLICABILITY

In operation the button 122 is assembled on the insert 120. For example, the proximal end 126 of the insert 120 is positioned within the neck 132 of the button 122. A force is applied to the button 122 and the insert 120 to move the shank 127 past the neck 132 and into the undercut 133. At this position the shank 127 is maintained within the undercut 133 by the neck 132 and the hemispherical chamber 130 and the hemispherical proximal end 126 are free to rotate and pivot.

The distal end 124 is then press into the insert bore 118 and the flange 128 is in contacting relationship with the distal end 106.

Thus, the rocker arm 102 is installed in the engine. The rocker arm 102 pivots about the transverse central bore 108. The screw is adjusted to provide an operating clearance for the valve train assembly and the adjusting mechanism 116 is tightened against the proximal end 104 maintaining the operating clearance of the valve train. With the interface of the button 122 and the insert 120 the interface of the rocker arm 102 and the push rod 123 is maintained in an effective operational relationship.

With the configuration of structure described above, it is to be appreciated that the hemispherical end 126 of the insert 120, specifically the shank 127 within the undercut 133 engages the neck 132 formed by the button 122 in such a manner that will allow the button 122 to rotate an pivot with respect to the insert 120, while at the same time, preventing the button 122 from being removed from the insert 120. Thus, damage to the engine from the button 122 is eliminated in engines having the rocker arm assembly 100 installed therein.

While the particular rocker arm assembly 100 as herein shown and described in detail is fully capable of attaining the above described objects of the invention, it is to be understood that it is the presently preferred embodiment of the present invention and is thus representative of the subject matter which is broadly contemplated by the present invention. The scope of the present invention fully encompasses other embodiments which may become obvious to those skilled in the art, and the scope of the present invention is accordingly to be limited by nothing other than the appended claims, in which reference to an element in the singular is not intended to mean "one and only one" unless explicitly so stated, but rather "one or more." All structural and functional equivalents to the elements of the above described preferred embodiment that are known or later come to be known to those of ordinary skill in the art are intended to be encompassed by the present claims. Moreover, it is not necessary for a device or method to address each and every problem sought to be solved by the present invention, for it is to be encompassed by the present claims.

What is claimed is:

1. A rocker arm assembly comprising:

a rocker arm forming an insert bore and an adjusting mechanism bore;

an adjusting mechanism disposed within the adjusting mechanism bore;

an insert disposed within the insert bore, the insert including a hemispherical distal end; and a button forming a hemispherical chamber sized and shaped to receive the hemispherical distal end of the insert, the button being press fitted onto the insert.

2. The rocker arm assembly of claim 1, wherein the button rotates on the insert.

3. The rocker arm assembly of claim 1, wherein the insert includes a shank and the button includes a neck, the neck cooperating with the shank to hold the button on the insert.

4. The rocker arm assembly of claim 3, wherein the neck has a diameter that is slightly smaller than a diameter of the shank such that the neck holds the button on the insert.

5. The rocker arm assembly of claim 3, wherein the button includes an undercut and the shank is positioned in the undercut.

6. A method for assembling a rocker arm assembly, comprising the steps of:

providing a rocker arm forming an insert bore and an adjusting mechanism bore;

providing an insert having a hemispherical end;

providing a button forming a hemispherical chamber that is sized and shaped to receive the hemispherical end;

pressing the button onto the insert;

installing the insert within the insert bore; and installing an adjusting mechanism within the adjusting mechanism bore.

7. The method of claim 6, wherein the insert includes a shank and the button includes a neck, and the step of pressing the button onto the insert results in the neck cooperating with the shank to hold the button on the insert.

8. The method of claim 7, wherein the neck has a diameter that is slightly smaller than a diameter of the shank to allow the neck to hold the button on the insert after the step of pressing the button onto the insert.

9. The method of claim 7 wherein the button includes an undercut and the shank is positioned in the undercut after the step of pressing the button onto the insert.

10. A system for opening and closing valves within an engine comprising:

a rocker arm forming an insert bore, a transverse central bore, and an adjusting mechanism bore;

an insert disposed within the insert bore, the insert including a hemispherical distal end;

a button forming a hemispherical chamber sized and shaped to receive the hemispherical distal end of the insert, the button being press fitted onto the insert;

an adjusting mechanism disposed within the adjusting mechanism bore;

a push rod in contact with the adjusting mechanism, the push rod causing the rocker arm to pivot about the transverse central bore; and a valve bridge in contact with a valve and in contact with the button, the pivoting of the rocker arm causing the opening of the valve.

11. The system of claim 10, wherein the button pivots on the insert.

12. The system of claim 11, wherein the insert includes a shank and the button includes a neck, the neck cooperating with the shank to hold the button on the insert.

13. The system of claim 12, wherein the neck has a diameter that is slightly smaller than a diameter of the shank to allow the neck to hold the button on the insert.

14. The system of claim 11, wherein the button includes an undercut and the shank is positioned in the undercut.

15. An engine having a cylinder and a valve train having a rocker arm assembly and a valve being operative between an open position and a closed position, said engine comprising:

a rocker arm forming an insert bore and an adjusting mechanism bore;

an adjusting mechanism disposed within the adjusting mechanism bore;

an insert disposed within the insert bore, the insert including a hemispherical distal end; and a button forming a hemispherical chamber sized and shaped to receive the hemispherical distal end of the insert, the button being press fitted onto the insert.

16. The engine of claim 15, wherein the insert includes a shank and the button includes a neck, the neck cooperating with the shank to hold the button on the insert.

17. The engine of claim 16, wherein the neck has a diameter that is slightly smaller than a diameter of the shank such that the neck holds the button on the insert.

18. The engine of claim 16, wherein the button includes an undercut and the shank is positioned in the undercut.

* * * * *